US005375347A

United States Patent [19]

Fleischhaker

[11] Patent Number: 5,375,347

[45] Date of Patent: Dec. 27, 1994

[54] BUCKET WHEEL WITH SUPPORTING BODY

[75] Inventor: Wolfgang Fleischhaker, Bad Schwartau, Germany

[73] Assignee: O&K Orenstein & Koppel Aktiengesellschaft, Dortmund, Germany

[21] Appl. No.: 720,431

[22] PCT Filed: Dec. 10, 1990

[86] PCT No.: PCT/EP90/02139

§ 371 Date: Dec. 9, 1992

§ 102(e) Date: Dec. 9, 1992

[87] PCT Pub. No.: WO91/19861

PCT Pub. Date: Dec. 26, 1991

[30] Foreign Application Priority Data

Jun. 9, 1990 [DE] Germany ..... 4018514
Aug. 23, 1990 [DE] Germany ..... 4026590

[51] Int. Cl.[5] ..... E02F 5/08

[52] U.S. Cl. ..... 37/94; 37/446; 37/189

[58] Field of Search ..... 37/70, 91, 189, 190, 37/94, 95, 96, 97, 446, 450

[56] References Cited

U.S. PATENT DOCUMENTS 3,871,118 3/1975 Brech ..... 37/189
3,968,580 7/1976 Lombardi et al. ..... 37/189
5,095,640 3/1992 Mohr ..... 37/189

FOREIGN PATENT DOCUMENTS 711240 9/1941 Germany ..... 37/189
763672 3/1954 Germany ..... 37/189
1073402 1/1960 Germany .
2107323 8/1972 Germany .
2314241 9/1974 Germany .
2609965A1 9/1976 Germany .
3822235A1 1/1990 Germany .
1416558 12/1975 United Kingdom ..... 37/189
422819 9/1974 U.S.S.R. ..... 37/189
1601289 10/1990 U.S.S.R. ..... 37/189

*Primary Examiner*—Randolph A. Reese
*Assistant Examiner*—J. Russell McBee
*Attorney, Agent, or Firm*—Spencer, Frank & Schneider

[57] ABSTRACT

A bucket wheel has a conical supporting body constructed as an inner shell rotatably mounted on the bucket wheel axis and a device which co-operates with the supporting body to accommodate the buckets on the outer rim of the bucket wheel. The supporting body is prolonged radially by a prismatic-type outer shell arranged on the supporting body parallel to the device, which has cell-forming dividing walls on its radially outward peripheral region. The prismatic shell, viewed in the radial direction, is shaped from a plurality of approximately trapezoidal steel plates which are welded to one another, making a plurality of bends, to form a polygonal conical envelope.

10 Claims, 4 Drawing Sheets

BUCKET WHEEL WITH SUPPORTING BODY

BACKGROUND OF THE INVENTION

1. Field of the Invention

The invention relates to a bucket wheel equipped with a single-wall conical supporting body that is constructed as an inner shell and is rotatably mounted on the bucket wheel axis. The invention also relates to a device cooperating with the supporting body for accommodating the buckets at the outer circumference of the bucket wheel.

2. Description of the Related Art

German Patent 2,314,241 discloses a non-cellular bucket wheel which has a conically configured supporting body that is rotatably mounted on the bucket wheel axis and at which is fastened an annular carrier carrying the buckets. The supporting body is composed of a single supporting disc configured in the form of the envelope of a cone frustum. This configuration has the advantage of a very simple structure, with no welding work being necessary within a spatial body. Moreover, these bucket wheels have the additional advantages that no incompatibilities with respect to the shape exist at the connection between wheel and shaft nor any sudden changes in rigidity. Additionally, no or hardly any surfaces exist which would permit the attachment of dirt. Since it is not possible to manufacture the supporting bodies of one piece in dependence on the diameter of the bucket wheels, segments must be produced here which lead to problems with structural tolerances when later welded together. The additional danger exists that the disc composed of a relatively thin metal sheet is deformed during welding and must thus be put on the scrap heap. However, alternative manufacturing processes such as, for example, deep drawing of a metal sheet, are able to overcome these drawbacks.

German examined published patent application DE-AS 1,073,402 discloses a bucket wheel for excavators. The hub supported on the bucket wheel axis by two bearing locations has a conical configuration and its tapered end is disposed on the side of the bucket wheel facing away from the discharge side. Moreover, the discharge chutes are connected to the broadened end of the hub and are connected with the tapered end of the hub by supporting struts. The ring carrying the buckets is connected with the hub by spokes that do not extend radially to the bucket wheel axis; they preferably extend tangentially to the tapered end of the hub. This embodiment, which is known as a spoke wheel, has the drawback that it requires a relatively large amount of welding work in the region of the inner and outer circumference of the bucket wheel. Moreover, the danger exists here that dirt is able to accumulate relatively quickly in the free spaces between the spokes and thus jeopardizes the proper operation of the bucket wheel. Although it is easy to see the dirt in view of the open configuration, it is relatively expensive to remove it.

German unexamined published patent application DE-OS 2,609,965 discloses a bucket wheel for loading or manipulating bulk materials. The bucket wheel is equipped with compartments (cells) for emptying the bulk material, with partitions in the housing structure forming the compartments for the buckets. At least some of the compartments are open at the edge of the housing structure to receive material to be conveyed from the buckets. The compartments extend diagonally inwardly from the edge of the housing structure in a direction opposite to the direction of rotation of the bucket wheel. The compartments are provided with deflecting surfaces that slope radially inwardly and at an angle in the direction of rotation of the bucket wheel from one side face of the housing structure toward a discharge edge of extended length in the second-side face of the housing structure. This relatively complicated structural embodiment, also known as a cellular wheel, is relatively heavy, on the one hand, and, on the other hand, has the drawback that numerous metal sheets and reinforcements must be provided at the side walls of the bucket wheel. The bucket wheel is composed of a plurality of chambers, with the weld seams being absolutely inaccessible. Large areas are formed where dirt is able to collect. Here again two bearing locations are required to support the complicated structure. Particularly in connection with stockpile clearing devices (bucket wheels), the advantage exists that the sloped cell faces which extend radially inwardly are amenable to the flow of material and thus the inwardly successive material intake location (conveyor belt) is protected if heavy chunks come in.

The prior art bucket wheels in use thus include the so-called non-cellular bucket wheels, spoke wheels and cellular bucket wheels, with the robust cellular wheels also being usable for difficult applications.

SUMMARY OF THE INVENTION

It is an object of the invention to provide a bucket wheel that incorporates the advantages of a single-wall non-cellular bucket wheel and those of a cellular bucket wheel, with the drawbacks of the double walls of a cellular wheel being avoided.

This is accomplished in that an outer shell in the form of a folded structure is disposed on the supporting body as a radially opposite extension of the supporting body in the direction of the device and is provided with partitions in its radially outward circumferential region for the formation of cells. The drawbacks of the cellular wheel (two walls and two bearing locations) are avoided in favor of the single-wall non-cellular wheel, with the advantages of the cellular wheel (good flow of material) remaining in effect.

Advantageous modifications of the subject matter of the invention are defined in the dependent claims.

Thus, the subject matter of the invention reflects a single-wall cellular bucket wheel in which one of the two side walls of the conventional cellular wheel configuration can be eliminated and the advantages of the non-cellular bucket wheel remain in effect in their entirety. Still no cavities exist in which dirt could collect to thus endanger the stability of the bucket wheels. Moreover, no sudden changes in rigidity (steps, etc.) exist which lead to fatigue damage. In addition, no damage results from any incompatibility of shape at the point of connection between wheel and shaft.

BRIEF DESCRIPTION OF THE DRAWINGS

The invention will now be described in greater detail with reference to one embodiment thereof that is illustrated in the drawing, in which.

DESCRIPTION OF THE PREFERRED EMBODIMENT

Figure 1:
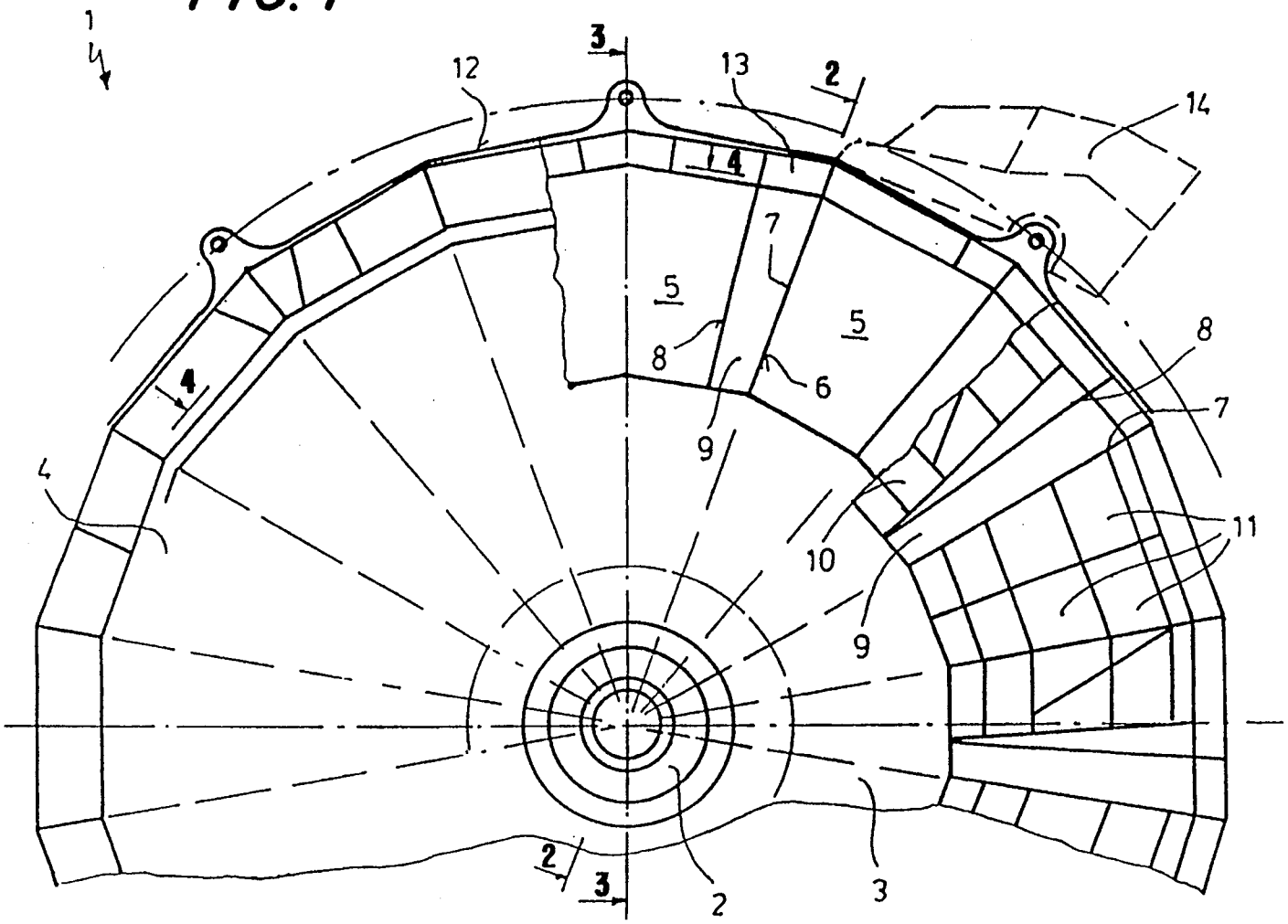
FIG. 1 is a side view of the bucket wheel according to the invention showing various section lines.
Figure 4:
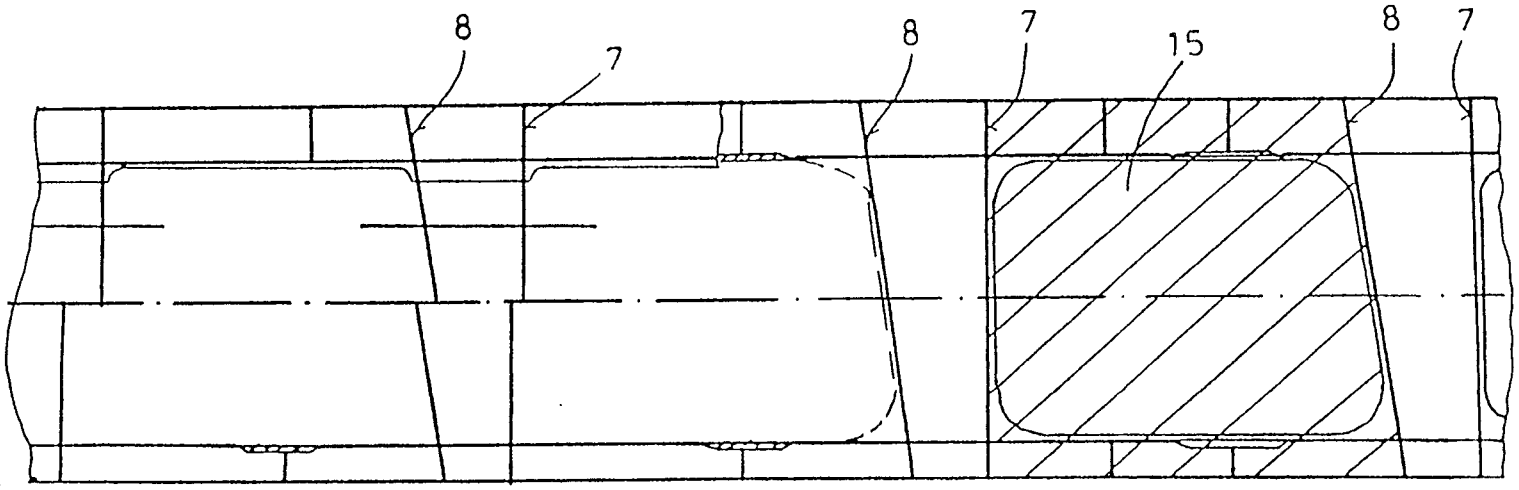
FIG. 4 is a sectional view along line C—C of the bucket wheel according to FIG. 1.
Figure 5:
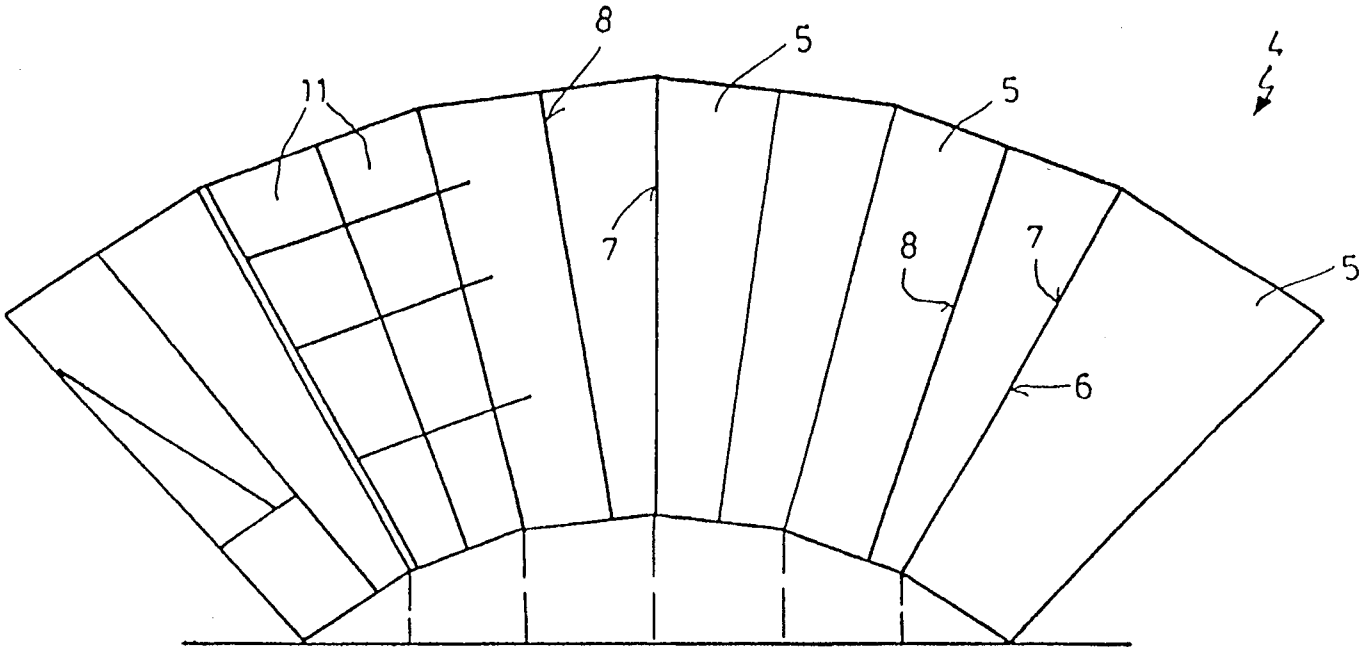
FIG. 5 is a partial development of the outer shell of the bucket wheel according to FIG. 1.

FIG. 1 is a side view of the bucket wheel 1 according to the invention. Shown is a hub 2 by which it is rotatably fastened on a non-illustrated drive shaft. An inner shell 3 in the form of a frustoconical envelope extends essentially radially from hub 2. Shaped to it is an outer shell 4 in the form of a folded structure, with inner shell 3 and outer shell 4 being connected together by welding. Folded structure 4, which will be discussed in greater detail in connection with FIGS. 4 and 5, is composed of a plurality of identical, trapezoidal metal sheets 5 which are likewise fixed to one another by welding and have the shape of a polygonal cone frustum. Partitions 7 that extend perpendicular to the individual metal sheets 5 are disposed on the bends 6 of the planar faces of the individual metal sheets 5. For reasons of rigidity, so-called sub-dividing sheets 8 may be provided in addition to partitions 7 to form boxes 9 together with partitions 7. For the purpose of protection, wear plates, or sheets, 11 are welded to the sloped faces 10 of metal sheets 5. The outer circumferential surface 12 of bucket wheel 1 also has a polygonal cross section. Devices 13 (annular carriers) which have a box-shaped cross section are provided in the region of the outer circumferential surface 12; they likewise have a polygonal cross section and serve to accommodate indicated-only buckets 14.

Figure 2:
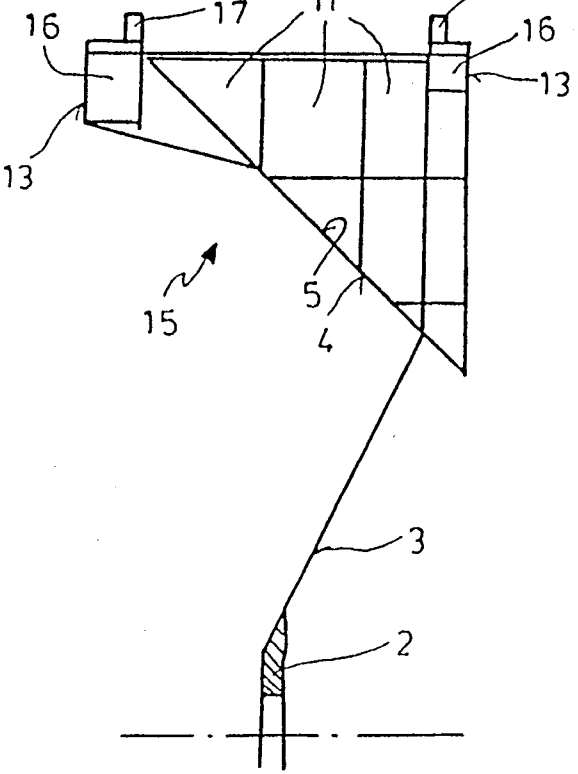
FIG. 2 is a sectional view along line A—A of the bucket wheel according to FIG. 1.

FIG. 2 is a sectional view seen along line A—A of FIG. 1. Visible are the inner shell 3 together with the hub 2, the outer shell 4 as well as cells 15. Also visible are the boxes 16 of devices 13 and their rear receiving elements 17 for buckets 14. Additionally, wear sheets 11 are shown which enhance the flow of material and are welded at small distances from one another to the sloped faces of metal sheets 5.

Figure 3:
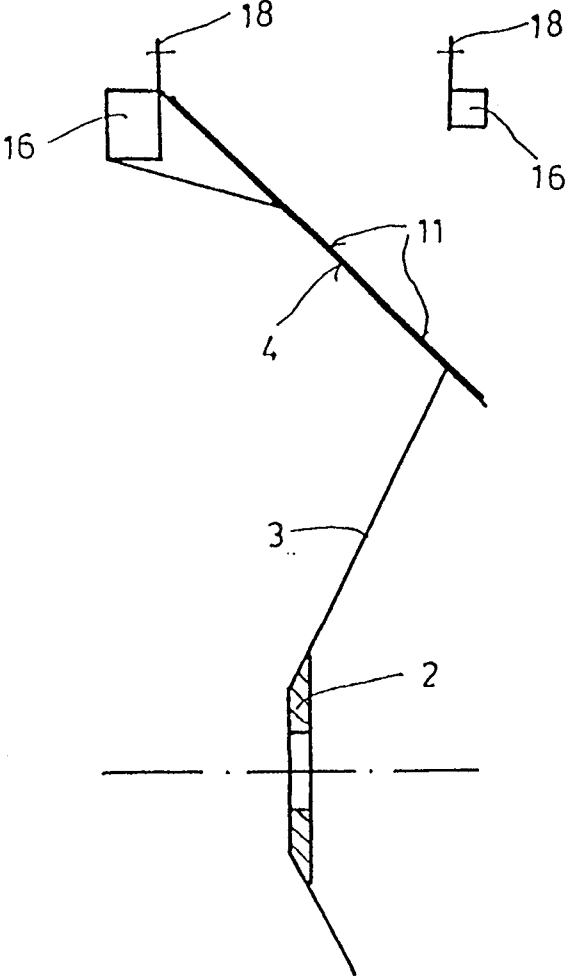
FIG. 3 is a sectional view along line B—B of the bucket wheel according to FIG. 1.

FIG. 3 is a cross-sectional view of the bucket wheel of FIG. 1 as seen along line B—B. Visible is the hub 2, the inner shell 3, the outer shell 4, boxes 16 as well as the front receiving elements 18 for buckets 14. The already mentioned wear sheets 11 are welded to the sloped face of outer shell 4.

FIG. 4 is a sectional view of FIG. 1 seen along line C—C. Visible are partitions 7 that are perpendicular to bends 6 and the sub-dividing sheets 8 arranged next to them. The individual cells 15 are each formed by a partition 7 and a sub-dividing sheet 8.

FIG. 5 is a partially developed view of the outer shell 4. Visible are the individual trapezoidal metal sheets 5 and bends 6, the raised partition walls 7, the sub-dividing sheets 8 as well as the wear sheets 11.

I claim:

1. A bucket wheel including a single-walled conical supporting body in the form of an inner shell which is rotatably mounted on an axis of the bucket wheel and a device cooperating with the supporting for accommodating buckets at an outer circumference of the bucket wheel, characterized in that, as a radially oppositely directed extension of the supporting body in the direction toward the device, an outer shell formed with a folded structure disposed on the supporting body, having partitions for forming cells at a radially outer circumferential region.

2. A bucket wheel according to claim 1, wherein the folded structure of the outer shell is composed of a plurality of approximately trapezoidal metal sheets.

3. A bucket wheel according to claim 1, wherein the outer shell is formed from metal sheets connected with one another in such a way to form the folded structure in the form of a polygonal cone envelope including a plurality of sharp bends.

4. A bucket wheel according to claim 1, wherein the partitions are arranged with subdividing sheets in the radial direction to form spaces between the partitions and the subdividing sheets which decrease in the radially inward direction.

5. A bucket wheel according to claim 1, further including wear sheets provided in a region of trapezoidal metal sheets which form the folded structure of the outer shell.

6. A bucket wheel according to claim 1, wherein the inner shell and the outer shell are welded together, the inner shell having a cone envelope adapted in the region of the weld to a polygonal surface of the outer shell.

7. A bucket wheel according to claim 1, wherein the outer shell and the cells for accommodating the buckets provided at the outer circumference of the wheel are configured to create a geometrical shape of a polygon.

8. A bucket wheel according to claim 1, wherein the device for accommodating the buckets (14) is formed from two polygonal rings which are each shaped to an end face of the outer shell.

9. A bucket wheel including, a single-walled conical supporting body in the form of an inner shell which is rotatably mounted on an axis of the bucket wheel; and a device cooperating with the supporting body for accommodating buckets at an outer circumference of the bucket wheel, wherein an outer shell is disposed on the supporting body and is formed with a folded structure as a radially oppositely directed extension of the supporting body in the direction toward the device, the folded structure having partitions for forming cells at a radially outer circumferential region, and wherein the partitions are disposed on bends of planar faces of the folded structure and extend substantially perpendicular to the folded structure.

10. A bucket wheel including, a single-walled conical supporting body in the form of an inner shell which is rotatably mounted on an axis of the bucket wheel; and a device cooperating with the supporting body for accommodating buckets at an outer circumference of the bucket wheel, wherein an outer shell is disposed on the supporting body and is formed with a folded structure as a radially oppositely directed extension of the supporting body in the direction toward the device, the folded structure having partitions for forming cells at a radially outer circumferential region, and wherein sub-dividing metal sheets for forming boxes are disposed on planar faces of the folded structure, at least partially next to the partitions and extending substantially perpendicular to the folded structure.

* * * * *